United States Patent [19]

Deciutiis

[11] Patent Number: 4,821,952

[45] Date of Patent: Apr. 18, 1989

[54] AUTOMATICALLY RETRACTABLE RURAL MAIL BOX

[76] Inventor: Laura Deciutiis, Woodside Dr., Dover Plains, N.Y. 12522

[21] Appl. No.: 150,036

[22] Filed: Jan. 29, 1988

[51] Int. Cl.[4] ..... B65D 91/00

[52] U.S. Cl. ..... 232/17; 232/39; 248/128

[58] Field of Search ..... 232/34, 17, 38; 248/128, 416

[56] References Cited

U.S. PATENT DOCUMENTS

| | | | |
|---|---|---|---|
| 1,094,529 | 4/1914 | Christiansen | 232/39 |
| 1,430,476 | 9/1922 | Trekell | 248/128 X |
| 1,731,682 | 10/1929 | Pendergrass | 248/128 |
| 2,723,098 | 11/1955 | Moore | 248/128 |
| 3,497,078 | 2/1970 | Nash | 232/39 X |
| 3,870,262 | 3/1975 | Manning | 232/39 X |
| 3,881,650 | 5/1975 | Schmidt | 232/39 |

*Primary Examiner*—Robert W. Gibson, Jr.
*Attorney, Agent, or Firm*—Lilling & Greenspan

[57] ABSTRACT

An automatically retractable rural mailbox which includes a mailbox which is slideably or rotatably mounted in relation to a fixed frame mounted on a post and which is automatically returned to its normal position by means of a spring. However, the mailbox is returned after being extended only after mail has been deposited in the mailbox and the letter carrier has again closed the mailbox door. This is achieved by a locking bar which locks the mailbox in an extended position, and a releasing bar which unlocks the locking bar and which cooperates with the door of the mailbox.

12 Claims, 3 Drawing Sheets

AUTOMATICALLY RETRACTABLE RURAL MAIL BOX

BACKGROUND OF THE INVENTION

1. Field of the Invention

This invention gradually relates to mailboxes, and more specifically to a rural mailbox which can be extended and automatically retracted to facilitate vehicular delivery of mail when snow has accumulated in the weak end of the mailbox.

2. Description of the Prior Art

A number of designs for rural mailboxes have been proposed which tend to simplify the problems of rural mail delivery thus, in U.S. Pat. No. 2,781,964, a mailbox structure is described, the primary object of which is to make it possible for the carrier to drive in a safe and proper position and yet be able to open the mailbox and deposit the mail therein, or remove it therefrom in a ready, easy and simple manner. To achieve this, the mailbox includes a series of cylindrical telescoping sleeves which can be extended into or adjacent to the road or retracted. An extensible mailbox is disclosed in U.S. Pat. No. 1,992,640 which includes a telescoping member engaging the body of the box and which can be manipulated from the front of the box so as to extend the length of the box, thereby permitting it to receive objects or packages unusually long.

Other mailboxes have been devised, exemplified in U.S. Pat. Nos. 703,143 and 1,494,181 which are provided with an extensible mounting for the mailbox, such as lazy-tongs, which permit the entire mailbox to be extended to make it accessible to the rural mail carrier without the necessity of his leaving his vehicle or driving the same off the roadway for the purpose. Other mailboxes which have been proposed and which include a feature of being removable in relation to the post upon which they are mounted are disclosed in U.S. Pat. Nos. 1,139,491; 2,804,263 and 4,114,801. These mailboxes, however, are generally complex in construction, and are each intended to facilitate the delivery of mail.

A mailbox is disclosed in U.S. Pat. No. 838,194 which includes an automatically sliding receptacle which brings the mail deposited in the box far enough out of the door to permit its being taken readily from the box, the mail tray being returned back into the mailbox when the door is closed. A similar slideable tray insert is disclosed in U.S. Pat. No. 4,600,143 where a tray insert molded from a plastic material is provided with a flexible finger element which moves the tray insert partially out of the mailbox to expose the handle of the tray when the mailbox is opened.

In all of the aforementioned and known mailboxes, the mailboxes remain in their extended positions after the mail has been deposited therein unless the mail carrier returns the mailbox to its normal retracted position.

The U.S. postal services has promulgated regulations regarding rural mailboxes. See "Domestic Mail Manual (DMM)". Regulation .54 requires that rural mailboxes must be placed so that they may be safely and conveniently served by carriers without leaving their conveyances, and also require that customers remove obstructions, including vehicles, trash cans, and snow that make delivery difficult. Regulation .232 outlines that delivery may be provided to boxes located at the curb so that they can be safely and conveniently served by the carrier from his vehicle. A problem that frequently arises in rural areas is that delivery becomes difficult, if not impossible, after a heavy snow. This condition is aggravated after the roadway has been plowed and snow has been piled up between the roadway and the post on which the mailbox is mounted. Frequently, in such situations, the mail carrier cannot bring his vehicle sufficiently close to the mailbox and, in some cases, the mail is not delivered under those circumstances. This is a serious problem, particularly for older and infirm people that cannot physically remove the snow which prevents the mail carrier from delivering the mail.

SUMMARY OF THE INVENTION

It is an object of the present invention to provide a rural mailbox which is simple in construction and economical to manufacture.

It is another object of the present invention to provide a rural mailbox which can be extended along the roadway to facilitate mail delivery even after snow has been plowed from the roadway.

It is still another object of the present invention to provide a rural mailbox of the type under discussion which automatically returns to its normal retracted position after the mail has been delivered.

It is yet another object of the present invention to provide a rural mailbox as aforementioned in the previous objects which is automatic in operation and has a high degree of reliability.

It is a further object of the present invention to provide a rural mailbox that can be used by all rural mailbox owners, especially the elderly and disabled.

In order to achieve the above objects as well as others which will become apparent hereafter, a rural mailbox in accordance with the present invention includes a housing having a bottom panel, a rear panel and a roof portion defining an enclosure for receiving mail through as opening at the end of said housing opposite to said rear panel. A door member is provided which is pivotly mounted at said mounting for movement between a closed position to close said opening and an open position permitting access to said enclosure through said opening. A generally fixed frame is provided, which is normally mounted on a post. Means are provided for movably mounted said housing on said fixed frame for movement between a normally retracted position substantially coextensive with said frame and an extended position substantially displaced from said frame to facilitate the placing of mail into said enclosure by a letter carrier making delivery by vehicle when displacement is in the direction of the road. Biasing means are provided acting between said fixed frame and said housing for urging said housing to revert to said retracted position. Locking means are provided for locking said housing in said extended position against the action of said biasing means. Unlocking means is provided for unlocking said locking means to thereby cause said housing to revert to said retracted position due to the action of said biasing means. In this manner, said housing can be extended to facilitate insertion of mail from a rural road and thereafter returned to its normal retracted position.

BRIEF DESCRIPTION OF THE DRAWINGS

The invention will now be more fully described and be better understood when reference is made to the following detailed description taken in conjunction with the accompanying drawings, in which.

DESCRIPTION OF A PREFERRED EMBODIMENT

Figure 1:
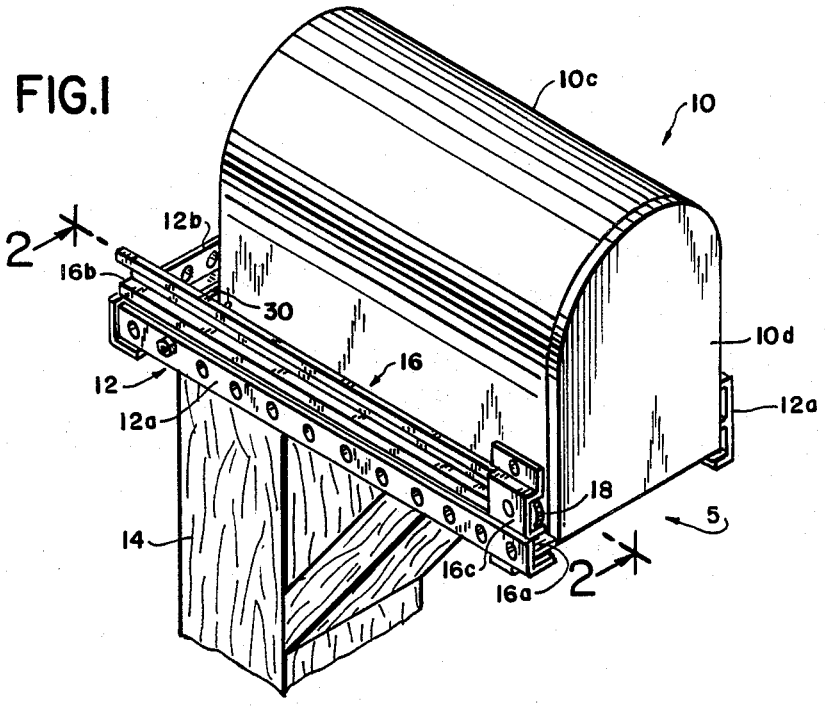
FIG. 1 is a perspective view of the rural mailbox in accordance with the present invention, showing the mailbox housing in its normal retracted condition.
Figure 2:
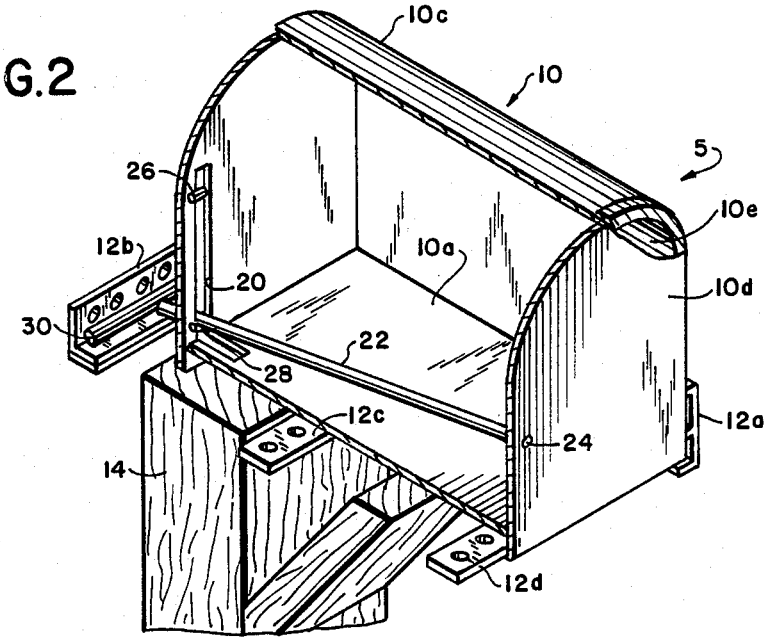
FIG. 2 is similar to FIG. 1, but showing the mailbox housing partially broken away to show the details of the locking and unlocking mechanism used to maintain the mailbox in an extended position.

Referring now specifically to the drawings, in which identical or similar parts are designated by the same reference numerals throughout, and first referring to FIGS. 1 and 2, a mailbox in accordance with the present invention is generally designated by the reference numeral 5.

The mailbox 5 includes a mailbox housing 10 having a bottom panel 10*a*, a rear panel 10*b* and an arched roof portion 10*c* which is generally U-shaped in cross-section as shown. It will be evident, however, that the specific configuration of the housing 10*c* and, particularly, of the roof portion 10*c* is not critical for purposes of the present invention.

The bottom panel 10*a*, the rear panel 10*b* and roof portion 10*c* together define an enclosure for receiving mail through an opening 10*e* at an end of the housing 10*c* opposite to the rear panel 10*b*. A door member 10*d* is pivotly mounted about pin 11 (FIGS. 3 and 4) at the opening 10*e* for movement between a closed position (FIGS. 1–3) to close the opening 10*e* and an open position permitting access to the enclosure through the opening 10*e*.

A generally fixed frame 12 is provided which is normally mounted on a post 14 in a conventional and known manner. Means 16 is provided for moveably mounting the housing 10 on the fixed frame 12 for movement between a normally retracted position (FIGS. 1–3) substantially coextensive with the frame 12 in an extended position (FIG. 4) substantially displaced from the frame 12 to facilitate the placing of mail into the enclosure by a mail carrier making delivery by vehicle. The mailbox housing 10 is displaced in the direction of the road.

The frame 12 may be made in any suitable manner. However, in order to minimize the cost of manufacture, it is contemplated that such frame may simply be made from a few lengths of L-angle bolt brackets, including side brackets 12*a* and rear bracket 12*b*. Such brackets are easy to cut and bolt together. The means for moveably mounting the mailbox consists of a roller track assembly 16 of the type used to mount drawers inside cabinets. Such assembly may include a lower track 16*a* mounted on the lower frame 12 and an upper track 16*b* connected to the sides of the mailbox housing 10. Such roller track assemblies include roller brackets 16*c* and rollers 18 which are received within the respective channels of the upper and lower tracks, such as upper channel 16*d* within which the roller 18 is rollably received. Any other sliding or rolling mechanism or arrangement may, of course, be used if it serves substantially the same purpose and achieves substantially the same result.

In order to reinforce the lower frame 12, bracing members 12*c* and 12*d* may be utilized (FIG. 2).

Figure 3:
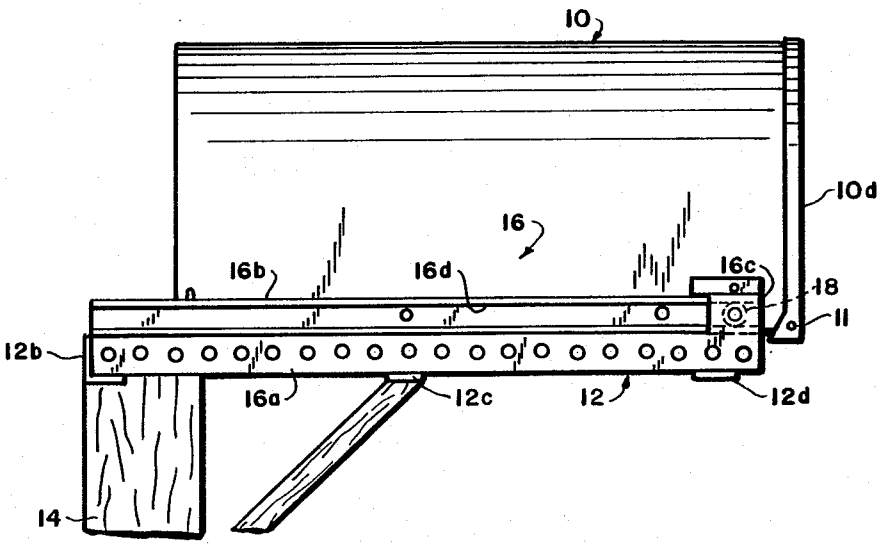
FIG. 3 is a side elevational view of the mailbox shown in FIG. 1, with the mailbox housing in its retracted position.

An important feature of the present invention is the position of biasing means acting between the fixed frame 12 and the mailbox housing 10 for urging the housing to revert to its normal retracted position shown in FIGS. 1—3. In a presently preferred embodiment, such biasing means is in the nature of a spring 34 one end of which is connected to the rear bracket 12*b*, while the other end of the spring 34 is connected to either the mailbox housing 10 or the upper track roller assembly attached thereto.

It should be clear that the mailbox housing 10 is moveably mounted between its normal retracted position and extended position, which can be any appropriate distance up to 3–5′. However, in order to minimize the cost of the mailbox, it is contemplated that ordinary slide roller track assemblies be used, whenever possible, which typically extend up to approximately 24″. Customized roller track assemblies can, however, be used, as well as any other mechanical or telescoping slide rolling assembly.

Figure 4:
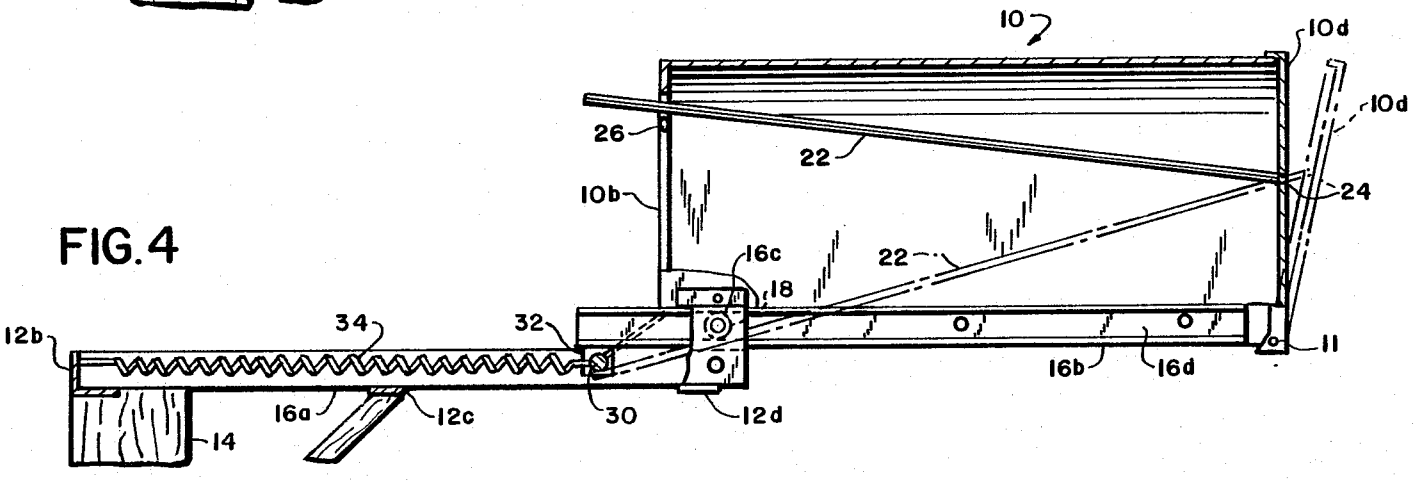
FIG. 4 is similar to FIG. 3, but showing the mailbox housing in its extended position, and partially broken away to illustrate the positions of the locking and unlocking mechanism for maintaining the mailbox in its extended position and for releasing the mailbox to its retracted position.

A feature of the present invention is the provision of locking means for locking the housing 10 in the extended position shown in FIG. 4 against the action of the spring 34 until such time that the mail has been deposited into the mailbox. Once the mail has been placed in the housing enclosure, and the door 10*d* has been closed, the mailbox is advantageously provided with unlocking means for unlocking the locking means to thereby causes the housing to revert to its retract position shown in FIGS. 1–3, due to the action of the spring 34. In this manner, the housing 10 can be extended to facilitate insertion from a rural road and thereafter returned to its normal retracted position.

In the presently preferred embodiment, the locking means consists of a locking bar 30 which is mounted on the housing 10 for sharing the movements between the retracted and extended positions of the housing 10. Bar engaging means in the nature of a recess 32 (FIG. 4) is provided on the fixed frame 12 for engaging the locking bar 30 in the extended position of the housing 10 thereby preventing the spring 34 from reverting the housing 10 to the retracted position until the locking bar 30 is released. In the presently preferred embodiment, the locking bar 30 is pivotly mounted on the housing 10 for movement between locking and releasing positions thus, the bar 30 slides above the lower track 16*a* until the housing 10 has sufficiently advanced to bring the locking bar 30 just above the recess 32 into which the locking bar drops and becomes captured. The weight of the locking bar 30 maintains it within the recess 32 and prevents the mailbox housing 10 from being returned to its normal retracted position despite of the biasing action or pulling action of the spring 34.

The unlocking means and the presently preferred embodiment comprises a releasing bar 22 which is pivotly connected to the door 10*d* at pivot point 24 (FIG. 2). It will be noted that the releasing bar 22 has a overall length greater than the mailbox housing 10 and it has its free end extending through a slot 20 in the rear panel 10*b*.

As best shown in FIGS. 2 and 4, the locking bar 30 is generally horizontally disposed and is pivoted about an axis generally parallel to the direction of movement of housing 10. The releasing bar, however, is oriented generally parallel to the direction of movement of the housing 10 and has its free end thereof which is positioned below the locking bar 30 to force the locking bar out of the notch or recess 32 when moved in a direction substantially parallel to the direction of the housing 10.

By being duly mounted on the door 10*d*, it will be evident that the opening and closing of the door moves the free end of the releasing bar 22 away from and towards the locking bar 30.

Advantageously, retaining means in the form of an upper pin 26 is provided at the upper end of the slot 20 for retaining the releasing bar 22 above the locking bar 30 when the door 10*d* is closed and for permitting the lock of the releasing bar to drop below the locking bar 30 when the door 10*d* is opened. The releasing bar 22 is arranged to urge the locking bar out from the notch or recess 32 when the door 10*d* is again closed after having been opened to deposit mail. In this manner, the housing is automatically returned to its normal retracted position when the mail carrier closes the door 10*d* after placing the mail into the mailbox.

Figure 5:
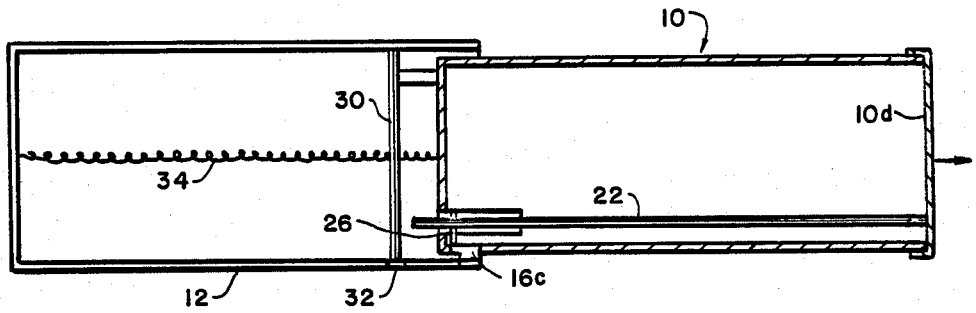
FIG. 5 is a diagrammatic top elevational view, broken away to show the relative positions of the locking and unlocking mechanisms of the mailbox in its extended position.

The operation of the mailbox is best described by reference to FIGS. 5–7. In FIG. 5, the mailbox is shown in its extended position, with its door 10*d* closed. The releasing bar 22 is in its raised or elevated position, being placed in that position in anticipation and in preparation of delivery by the mail carrier. The spring 34 is stretched in that position of the mailbox housing 10, although the housing cannot be returned to its normal position because of the locking engagement between the locking bar 30 and the recess or notch 32.

Figure 6:
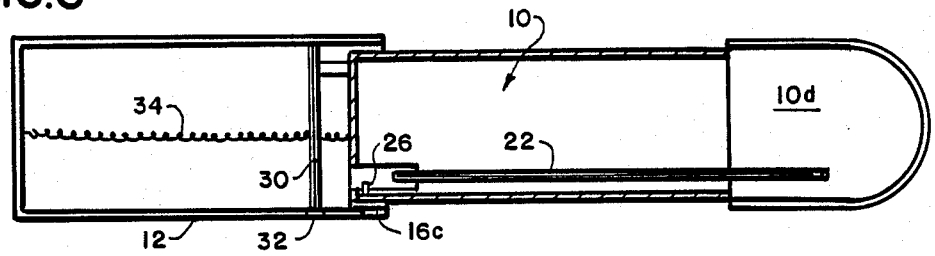
FIG. 6 is similar to FIG. 5, but showing the movement of the unlocking mechanism when the door to the mailbox is opened.
Figure 7:
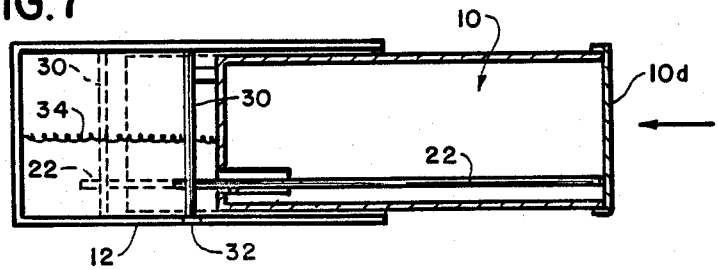
FIG. 7 is similar to FIGS. 5 and 6, but showing the position of the unlocking mechanism in relation to the locking mechanism once the door to the mailbox housing is again closed.

In FIGS. 6, the door can be shown in the opened position, such as when the mail carrier opens the door to place the mail therein. Upon this occurrence, the releasing bar 22 slides off of the upper pin 26 and drops onto a lower pin 28 which positions the free end of the releasing bar 22 at a point below the level of the locking bar 30. Now, once the door 10*d* is again closed, this forces the releasing bar rearwardly in the direction of the locking bar 30. Since the releasing bar 22 is inclined upwardly in the direction of the door 10*d*, continued advancement of the releasing bar 22 rearwardly in the direction of the locking bar 30 forces the locking bar to ride up on the releasing bar 22 until it is cleared of the recess or notch 32. As soon as the locking bar is raised above the notch or recess 32, the spring 34 can urge the mailbox housing 10 to revert to its normal retracted position as suggested in FIG. 7.

On days during the winter, therefore, when snow blocks the mailbox, it can now be extended forward for access by the mail carrier without shoveling the snow which is normally piled up in front of the mailbox due to the clearing the roads. During the rest of the year, of course, the mailbox may be retained in its normal closed or retracted position.

Thus, it can be seen from the foregoing specification and the attached drawings that the automatically retractable rural mailbox in accordance with the present invention provides an effective, simple and inexpensive means for facilitating deposit and removal of the mail in rural areas, both during good conditions as well as unfavorable conditions when snow has been plowed in front of the mailbox. This should insure delivery of the mail at all times during the year, and is particularly helpful to the elderly and disabled who cannot otherwise clear or shovel the snow which has been so plowed.

The preferred embodiment described achieves the objects of the invention. However, it will be appreciated that departure can be made by those skilled in the art without departing from the spirit and scope of the invention, which is limited only by the following claims.

What is claimed is:

1. A rural mailbox comprising a housing having a bottom panel, a rear panel and a roof portion defining an enclosure for receiving mail through an opening at an end of said housing opposite to said rear panel, and door member pivotally mounted at said opening for movement between a closed position to close said opening and an open position permitting access to said enclosure through said opening; a generally fixed frame; means for movably mounting said housing on said fixed frame for movement between a normally retracted position substantially coextensive with said frame and an extended position substantially displaced from said frame to facilitate the placing of mail into said enclosure by a letter carrier making delivery by vehicles when displacement is in the direction of the road; biasing means acting between said fixed frame and said housing for urging said housing to revert to said retracted position, locking means for locking said housing in said extended position against the action of said biasing means; and unlocking means responsive to closure of said door member for unlocking said locking means to thereby cause said housing to revert to said retracted position due to the action of said biasing means, whereby said housing can be extended to facilitate insertion of mail from a rural road and thereafter automatically returned to its normal retracted position subsequent to insertion of the mail into the mailbox and closure of said door member.

2. A mailbox as defined in claim 1, wherein said fixed frame is generally rectangular.

3. A mailbox as defined in claim 1, wherein said fixed frame is formed of two lateral brackets, a rear bracket extending between said lateral brackets and at last one bracing member spaced from said rear bracket and extending between said lateral brackets.

4. A mailbox as defined in claim 3, wherein said brackets are L-angle bolt brackets.

5. A mailbox as defined in claim 1, wherein said means for mounting comprises a track and recess assembly mounted between said fixed frame and said housing.

6. A mailbox as defined in claim 1, wherein said biasing means comprises a spring.

7. A rural mailbox comprising a housing having a bottom panel, a rear panel and a roof portion defining an enclosure for receiving mail through an opening at an end of said housing opposite to said rear panel, and a door member privotally mounted at said opening for movement between a closed position to close said opening and an open position permitting access to said enclosure through said opening; a generally fixed frame;

means for movably mounting said housing on said fixed frame for movement between a normally retracted position substantially coextensive with said frame and an extended position substantially displaced from said frame to facilitate the placing of mail into said enclosure by a letter carrier making delivery by vehicles when displacement is in the direction of the road; biasing means acting between said fixed frame and said housing for urging said housing to revert to said retracted position, locking means for locking said housing in said extensive position against the action of said biasing means; and unlocking means for unlocking said locking means to thereby cause said housing to revert to said retracted position due to the action of said biasing means, whereby said housing can be extended to facilitate insertion of mail from a rural road and thereafter returned to its normal retracted position, said locking means comprising a locking bar mounted on said housing for sharing the movements between said retracted and extended positions, and bar-engaging means on said fixed frame for engaging said locking bar in said extended position of said housing thereby preventing said biasing means from reverting said housing to said retracted position until said locking bar is released.

8. A mailbox as defined in claim 7, wherein said locking bar is pivotally mounted on said housing for movement between locking and releasing positions, said bar engaging means comprising a notch on said fixed frame for recovering said locking bar in said locking position.

9. A mailbox as defined in claim 8, wherein said unlocking means comprises a releasing bar which urges said locking bar to a releasing position out of said notch.

10. A mailbox as defined in claim 9, wherein said locking bar is generally horizontally disposed and pivoted about an axis generally parallel to the direction of movement of said housing, and said releasing bar is oriented generally parallel to the direction of movement of said housing and having one end positionable below said locking bar to force said locking bar out of said notch when moved in a direction substantially parallel to the direction of movement of said housing.

11. A mailbox as defined in claim 10, wherein said releasing bar is pivotally connected at the other end thereof to said door member, whereby closure of said door member causes said releasing bar to move below said locking bar out of said latch.

12. A mailbox as defined in claim 11, wherein said rear panel has a generally vertical slot through which said one end of said releasing bar extends, a retaining means being provided at the upper end of said slot for retaining said releasing bar above said locking bar when said door member is closed and for permitting said one end of said releasing bar being arranged to urge said locking bar out from said notch when said door member is again closed, whereby said housing is automatically returned to its normal retracted position when the mail carrier closes said door member after placing the mail into said enclosure.

* * * * *